US009507369B2

(12) United States Patent
Carlson et al.

(10) Patent No.: US 9,507,369 B2
(45) Date of Patent: Nov. 29, 2016

(54) DYNAMICALLY ADJUSTING SUPPLY VOLTAGE BASED ON MONITORED CHIP TEMPERATURE

(71) Applicant: Cavium, Inc., San Jose, CA (US)

(72) Inventors: David A. Carlson, Haslet, TX (US); Manan Salvi, Somerville, MA (US); Curtis Miller, Sterling, MA (US)

(73) Assignee: Cavium, Inc., San Jose, CA (US)

( * ) Notice: Subject to any disclaimer, the term of this patent is extended or adjusted under 35 U.S.C. 154(b) by 100 days.

(21) Appl. No.: 14/040,431

(22) Filed: Sep. 27, 2013

(65) Prior Publication Data

US 2015/0091638 A1 Apr. 2, 2015

(51) Int. Cl.
*G05F 5/00* (2006.01)
*G05F 1/46* (2006.01)

(52) U.S. Cl.
CPC ..... *G05F 5/00* (2013.01); *G05F 1/463* (2013.01)

(58) Field of Classification Search
USPC ..... 327/512–513, 538, 540
See application file for complete search history.

(56) References Cited

U.S. PATENT DOCUMENTS

| | | | | |
|---|---|---|---|---|
| 5,486,903 | A * | 1/1996 | Kanno et al. | 399/45 |
| 6,082,115 | A * | 7/2000 | Strnad | 62/3.7 |
| 7,117,382 | B2 * | 10/2006 | Khieu et al. | 713/401 |
| 8,356,194 | B2 | 1/2013 | Carlson et al. | |
| 8,723,594 | B2 * | 5/2014 | Sakaguchi | H03K 17/081 327/53 |
| 8,874,949 | B2 * | 10/2014 | Wells | G06F 1/26 702/127 |
| 8,975,951 | B2 * | 3/2015 | Inoue et al. | 327/513 |
| 2013/0104130 | A1 | 4/2013 | Carlson et al. | |

FOREIGN PATENT DOCUMENTS

| | | | |
|---|---|---|---|
| JP | 2009-152311 | A | 7/2009 |
| JP | 2013-0046677 | A | 1/2013 |

* cited by examiner

*Primary Examiner* — An Luu
(74) *Attorney, Agent, or Firm* — Hamilton, Brook, Smith & Reynolds, P.C.

(57) ABSTRACT

In an embodiment, a method includes monitoring a temperature of a semiconductor chip and adjusting a supply voltage to the semiconductor chip based on the monitored temperature. The temperature may be monitored by a temperature sensor located on-chip or off-chip. Adjusting the supply voltage includes increasing the supply voltage as a function of the monitored temperature decreasing. The increase to the supply voltage occurs only if the monitored temperature is below a threshold temperature. The supply voltage adjustment is determined by a linear relationship having a negative slope with temperature.

14 Claims, 4 Drawing Sheets

DYNAMICALLY ADJUSTING SUPPLY VOLTAGE BASED ON MONITORED CHIP TEMPERATURE

BACKGROUND

In semiconductor chip-design processing, it has generally been the case that the worst-case delay for a device is at the high-temperature corner. With recent advanced process technologies (40 nm and below) a temperature-inversion phenomenon has been observed. This phenomenon is where device performance worsens at cold temperature.

Transistor performance is highly correlated to supply voltage, i.e., higher voltage means higher performance. Chip power dissipation is composed of two components, dynamic and leakage. Dynamic power increases with the square of the supply voltage and is temperature insensitive. Leakage power also increases with supply voltage and is exponential with temperature.

SUMMARY

With the approach of the present disclosure, the problem with temperature inversion is addressed based on increasing a supply voltage to the chip in a region of low temperature. Accordingly, the example embodiments can increase transistor performance at low temperatures.

In an embodiment, a method includes monitoring a temperature of a semiconductor chip and adjusting a supply voltage to the semiconductor chip based on the monitored temperature. The temperature may be monitored by a temperature sensor located on-chip or off-chip. Adjusting the supply voltage includes increasing the supply voltage as a function of the monitored temperature decreasing. The increase to the supply voltage may occur only if the monitored temperature is below a threshold temperature. The supply voltage adjustment is determined by a linear relationship having a negative slope with temperature.

In another embodiment, an apparatus includes a temperature sensor for monitoring a temperature of a semiconductor chip and a controller configured to adjust a supply voltage to the semiconductor chip based on the monitored temperature. In some embodiments, the temperature sensor and the controller are located on the semiconductor chip. In other embodiments, the temperature sensor and the controller are located off the semiconductor chip.

The controller may be configured to send a control signal to a voltage regulator module (VRM) to cause the VRM to adjust the supply voltage. The controller may adjust the supply voltage by increasing the supply voltage as a function of the monitored temperature decreasing. The controller may increase the supply voltage only if the monitored temperature is below a threshold temperature.

In some embodiments the apparatus may include an on-chip thermal diode coupled to the temperature sensor that monitors a junction temperature on the chip.

The controller may be configured to adjust the supply voltage as determined by a linear relationship having a negative slope.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

A description of example embodiments of the invention follows.

Embodiments of the present invention relate to an on chip temperature sensor which feeds a control block. The control block, based on an algebraic equation, can instruct an external voltage regulator module (VRM) to increase or decrease the chip supply voltage. Higher supply voltage is provided by the VRM when the chip is at relatively low temperatures so as to compensate for the effect of lower temperature on transistor performance, with the result that the chip performance can be maintained more constant across temperatures. The fact that this is dynamic is important. The chip voltage cannot be increased all the time because when the chip is hot it will be drawing the most power and increasing supply voltage will result in exceeding the chip's power specification. Increasing the supply voltage when the chip is cold is possible because the reduced power from leakage can be traded off for the increased power from the higher supply voltage. Thus, the total power envelope of the chip will not be increased because of the vastly reduced leakage at low temperatures. It may also be permissible to exceed the stated power envelope when cold because the primary concern for power dissipation is keeping the chip cool. This is not a problem when the chip is cold.

It should be noted that increasing the supply voltage does not necessarily increase the system clock frequency. Without the present approach, the chips need to be tested at the lowest temperature in order to characterize the clock. With the present approach, it is likely that the worst case temperature is at the threshold temperature.

Figure 1:
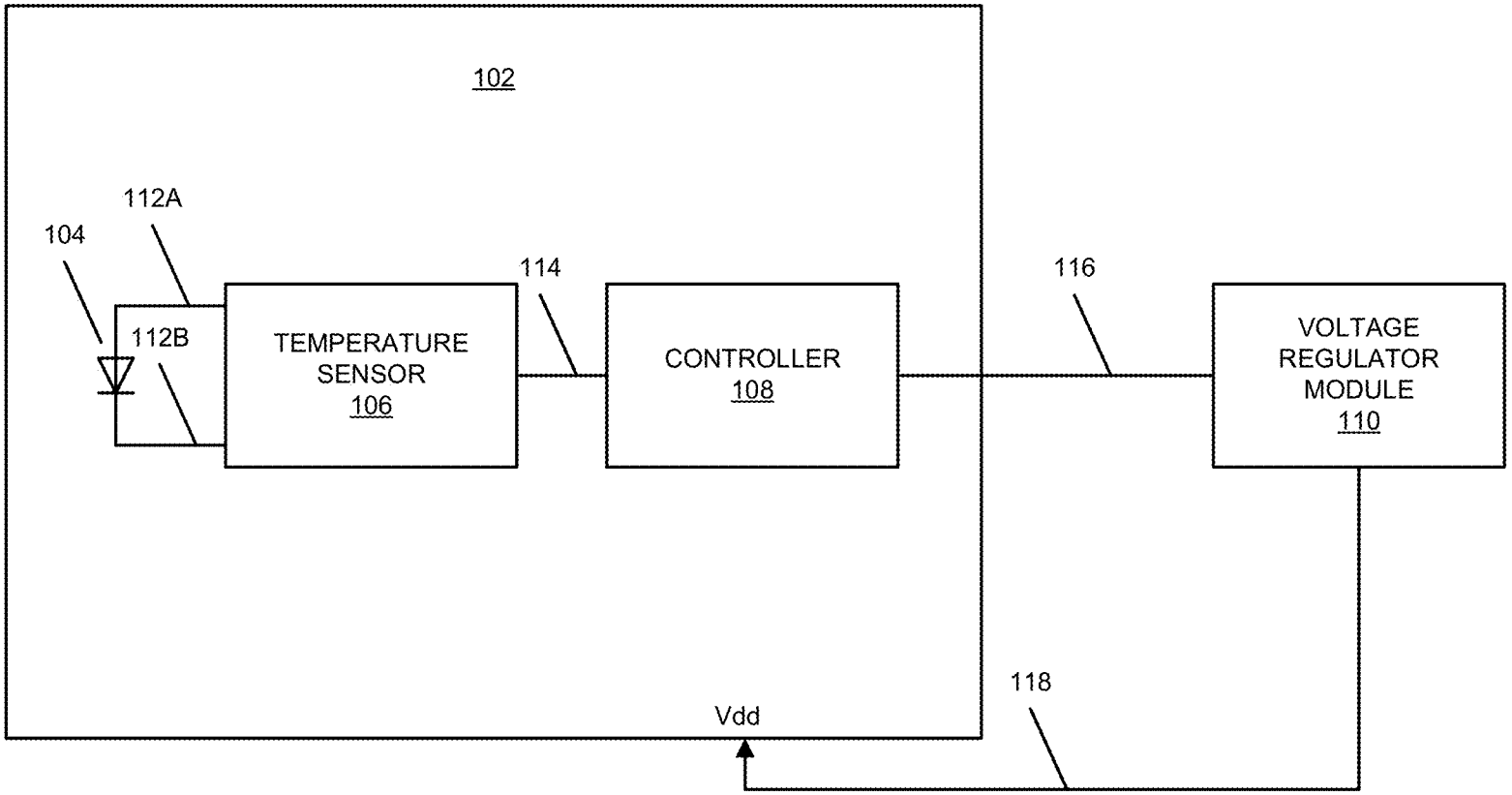
FIG. 1 is a block diagram of a first example embodiment of supply voltage adjustment circuitry.

FIG. 1 is a block diagram of a first example embodiment of supply voltage adjustment circuitry. The adjustment circuitry includes a thermal diode 104, a temperature sensor 106, a controller 108, and a voltage regulator module (VRM) 110. The thermal diode 104, temperature sensor 106, and controller 108 are embedded on a semiconductor chip 102. The VRM 110 is external to the chip 102.

The thermal diode 104 provides an indication of the junction temperature on the chip and is coupled at inputs 112A, 112B of the temperature sensor 106. The temperature sensor 106 is configured to monitor the junction temperature provided by the thermal diode 104. An output of the temperature sensor 106 is a signed 8 bit signal 114. This 8 bit signal 114 allows for reading temperatures between −128 degrees C. to +127 degrees C. with a 1 degree increment. The temperature sensor output 114 changes every time a temperature acquisition occurs, e.g., on the order of every millisecond.

The temperature sensor output 114 is provided as input to controller 108. The controller 108 is configured to control a supply voltage (Vdd) 118 output from the VRM 110. In particular, the controller 108 instructs the VRM 110 to dynamically increase or decrease the supply voltage Vdd based on the monitored temperature signal 114 provided to the controller 108. The controller 108 instructs the VRM 110 over connection 116 to increase the supply voltage Vdd with decreasing temperature when the monitored temperature is below a threshold temperature. An example relationship is as follows:

$$Vdd=Nominal_Vdd+MINIMUM(0,Temperature-Threshold)*Slope \quad \text{(Eq. 1)}$$

Nominal_Vdd, Threshold and Slope may be programmable values, controlled by writing a control/status register (CSR) or by blowing one or more one-time programmable (OTP) fuses. Values for a 28 nm process may be, for example:

Nominal_Vdd=900 m V

Threshold=50 C

Slope=−1 m V/C

It should be understood to one skilled in the art that, while (Eq. 1) includes a linear function, non-linear functions can be used to effect an increase in supply voltage with decreasing temperature.

In an embodiment, the connection 116 between the controller 108 and the VRM 110 uses Power Management Bus (PMBus), an open standard power-management protocol. In other embodiments, the connection can be provided using the Serial VID interface (SVID) specification or other suitable protocol. The VRM 110 can be, for example, an Intersil part number ISL6367 or other similar device.

Figure 2:
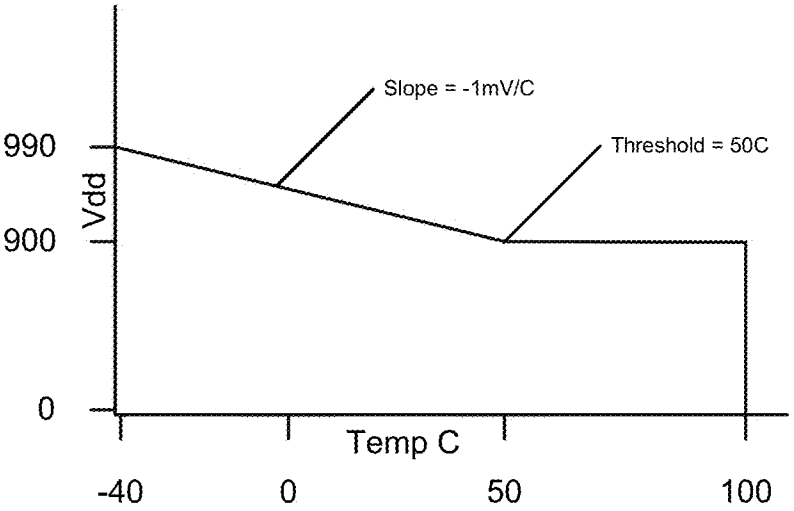
FIG. 2 is a line chart illustrating a relationship between supply voltage and temperature for an example supply voltage adjustment circuitry.

FIG. 2 is a line chart illustrating a relationship between supply voltage and temperature for an example supply voltage adjustment circuitry that is controlled based on (Eq. 1) and given the example values noted above. As shown, the supply voltage Vdd increases 50 mV when at 0 C and 90 mV when at −40 C. A flat or constant region for keeping the supply voltage at the nominal value 900 mV occurs for temperatures above the threshold value of 50 C. Below the threshold, the curve is linear with a negative slope.

Figure 3:
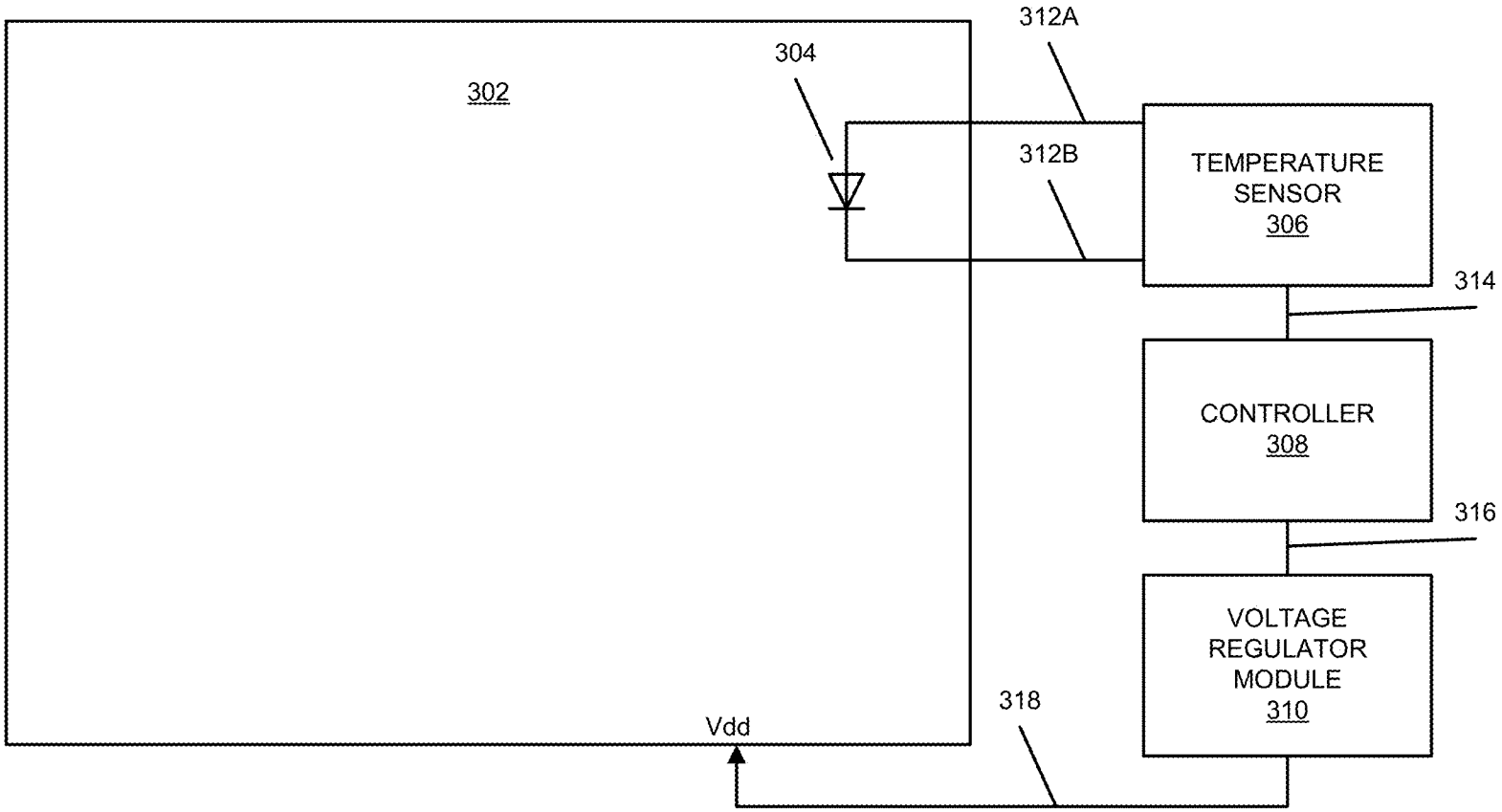
FIG. 3 is a block diagram of a second example embodiment of supply voltage adjustment circuitry.

FIG. 3 is a block diagram of a second example embodiment of supply voltage adjustment circuitry. The adjustment circuitry includes a thermal diode 304, a temperature sensor 306, a controller 308, and a voltage regulator module (VRM) 310. The thermal diode 104 is embedded on a semiconductor chip 302. The temperature sensor 306, controller 308, and VRM 310 are external to chip 302. The thermal diode 304 provides an indication of the junction temperature on the chip and is coupled at inputs 312A, 312B of the temperature sensor 306. The temperature sensor 306 is configured to monitor the junction temperature provided by the thermal diode 304. External temperature sensors are available from a number of sources, including Texas Instruments, Maxim, Analog Devices, and National Semiconductor. For example, a Texas Instruments TMP421 temperature sensor is suitable. The VRM 310 can be an Intersil part number ISL6367 or other similar device.

An output of the temperature sensor 306 is a signed 8 bit signal 314. This 8 bit signal 314 allows for reading temperatures between −128 degrees C. to +127 degrees C. with a 1 degree increment. The temperature sensor output 314 changes every time a temperature acquisition occurs, e.g., on the order of every millisecond.

The temperature sensor output 314 is provided as input to controller 308. The controller 308 is configured to control a supply voltage (Vdd) 318 output from the VRM 310. In particular, the controller 308 instructs the VRM 310 on connection 316 to dynamically increase or decrease the supply voltage Vdd based on the monitored temperature signal 314 provided to the controller 308. The controller 308 instructs the VRM 310 to increase the supply voltage Vdd with decreasing temperature when the monitored temperature is below a threshold temperature based on the relationship (Eq. 1).

Figure 4:
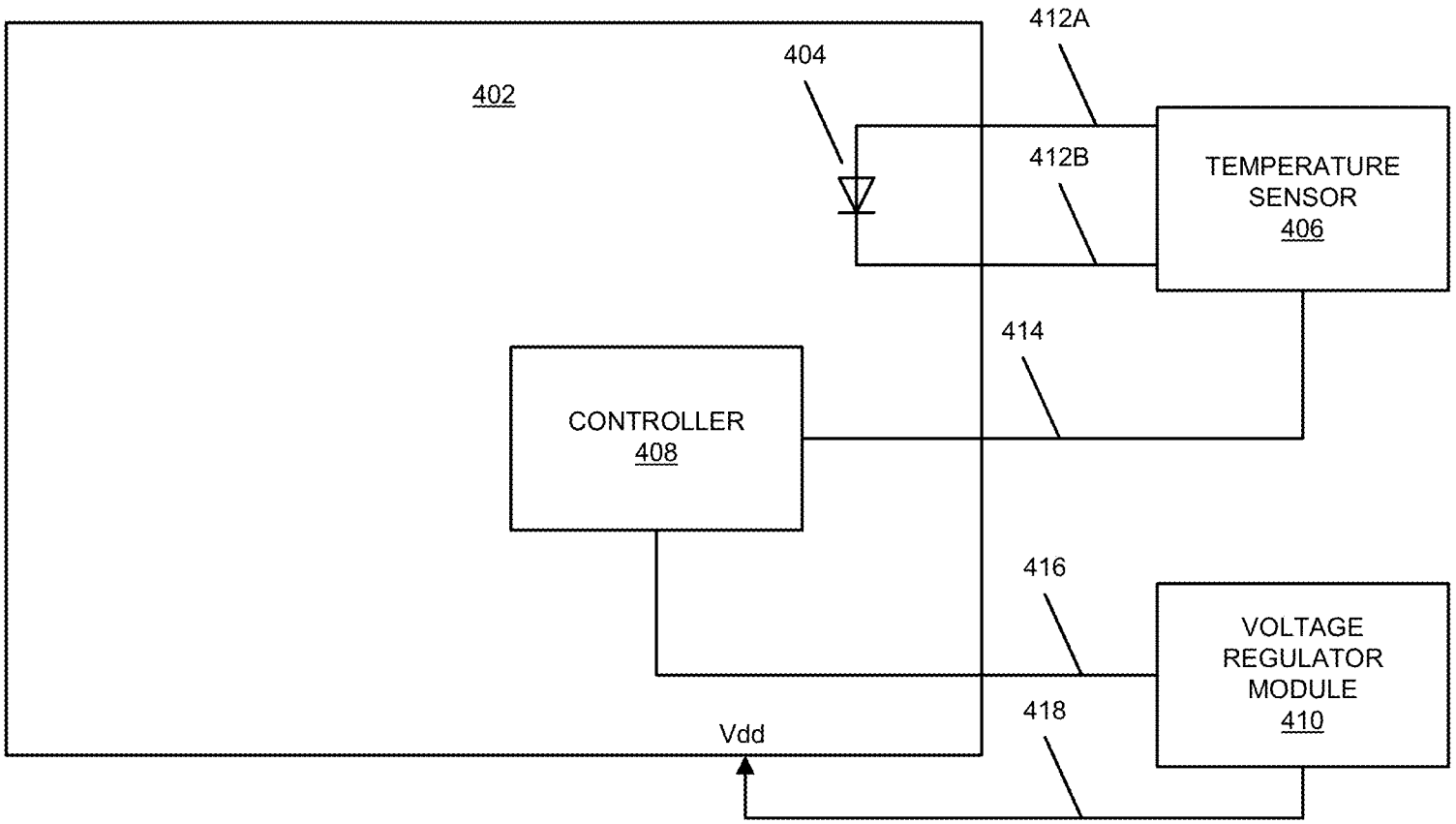
FIG. 4 is a block diagram of a third example embodiment of supply voltage adjustment circuitry.

FIG. 4 is a block diagram of a third example embodiment of supply voltage adjustment circuitry. The adjustment circuitry includes a thermal diode 404, a temperature sensor 406, a controller 408, and a voltage regulator module (VRM) 410. The thermal diode 404 and controller 408 are embedded on a semiconductor chip 402. The temperature sensor 406 and VRM 410 are external to chip 402. The thermal diode 404 provides an indication of the junction temperature on the chip and is coupled at inputs 412A, 412B of the temperature sensor 406. The temperature sensor 406 is configured to monitor the junction temperature provided by the thermal diode 404. Similar to the embodiment described above for FIG. 3, the Texas Instruments TMP421 temperature sensor and Intersil part number ISL6367 are suitable devices for the temperature sensor 406 and VRM 410, respectively.

An output of the temperature sensor 406 is a signed 8 bit signal 414 which allows for reading temperatures between −128 degrees C. to +127 degrees C. with a 1 degree increment. The temperature sensor output 414 changes every time a temperature acquisition occurs, e.g., on the order of every millisecond.

The temperature sensor output 414 is provided as input to controller 408 over a two-wire serial interface (TWSI) on the chip 402. The controller 408 is configured to control a supply voltage (Vdd) 418 output from the VRM 340 by instructing the VRM 410 on connection 416 (e.g., PMBus or SVID) to dynamically increase or decrease the supply voltage Vdd based on the monitored temperature signal 414 provided to the controller 408. The controller 408 instructs the VRM 410 to increase the supply voltage Vdd with decreasing temperature when the monitored temperature is below a threshold temperature based on the relationship (Eq. 1).

While this invention has been particularly shown and described with references to example embodiments thereof, it will be understood by those skilled in the art that various changes in form and details may be made therein without departing from the scope of the invention encompassed by the appended claims.

What is claimed is:

1. A method comprising:

monitoring a temperature of a semiconductor chip;

adjusting a supply voltage to the semiconductor chip by increasing the supply voltage as a continuous function of the monitored temperature decreasing, wherein adjusting the supply voltage occurs only if the monitored temperature is below a threshold temperature and the supply voltage adjusted is determined based on a linear relationship having a negative slope between the supply voltage and the monitored temperature as defined by the continuous function.

2. The method of claim 1 wherein the temperature is monitored by an on-chip temperature sensor.

3. The method of claim 1 wherein the temperature is monitored by an off-chip temperature sensor.

4. The method of claim 1 wherein the negative slope is a programmable value and the method further comprises controlling the linear relationship having the negative slope by writing to a register to change the programmable value.

5. Apparatus comprising:

a temperature sensor for monitoring a temperature of a semiconductor chip;

a controller configured to adjust a supply voltage to the semiconductor chip by increasing the supply voltage as a continuous function of the monitored temperature decreasing, wherein the controller is configured to adjust the supply voltage only if the monitored temperature is below a threshold temperature and the supply voltage adjusted is determined based on a linear relationship having a negative slope between the supply voltage and the monitored temperature as defined by the continuous function.

6. The apparatus of claim 5 wherein the temperature sensor and the controller are located on the semiconductor chip.

7. The apparatus of claim 5 wherein the temperature sensor and the controller are located off the semiconductor chip.

8. The apparatus of claim 5 wherein the controller is configured to send a control signal to a voltage regulator module (VRM) to cause the VRM to adjust the supply voltage.

9. The apparatus of claim 5 further comprising an on-chip thermal diode coupled to the temperature sensor that monitors a junction temperature on the chip.

10. The apparatus of claim 5 wherein the negative slope is a programmable value, the apparatus further comprises a register, and the controller is further configured to control the linear relationship having the negative slope by writing to a register to change the programmable value.

11. Apparatus comprising:

means for monitoring a temperature of a semiconductor chip;

means for adjusting a supply voltage to the semiconductor chip including means for increasing the supply voltage as a continuous function of the monitored temperature decreasing, wherein the means for increasing the supply voltage operates to adjust only if the monitored temperature is below a threshold temperature and the supply voltage adjusted is determined based on a linear relationship having a negative slope between the supply voltage and the monitored temperature as defined by the continuous function.

12. The apparatus of claim 11 wherein the means for monitoring is an on-chip temperature sensor.

13. The apparatus of claim 11 wherein the means for monitoring is an off-chip temperature sensor.

14. The apparatus of claim 11 wherein the negative slope is a programmable value and the apparatus further comprises a means for controlling the linear relationship having the negative slope by writing to a register to change the programmable value.

* * * * *